US009395116B1

(12) United States Patent
Arnold et al.

(10) Patent No.: US 9,395,116 B1
(45) Date of Patent: Jul. 19, 2016

(54) DUAL TEMPERATURE INSULATED CONTAINER

(71) Applicant: SONOCO DEVELOPMENT, INC, Hartsville, SC (US)

(72) Inventors: David Alan Arnold, Schererville, IN (US); Gary Hase, Monee, IL (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 14/838,713

(22) Filed: Aug. 28, 2015

(51) Int. Cl.

| | |
|---|---|
| ***F25D 23/00*** | (2006.01) |
| ***F25D 23/06*** | (2006.01) |
| ***F25D 23/02*** | (2006.01) |
| ***F25D 23/08*** | (2006.01) |

(52) U.S. Cl.
CPC ..... *F25D 23/065* (2013.01); *F25D 23/028* (2013.01); *F25D 23/069* (2013.01); *F25D 23/08* (2013.01); *F25D 2201/126* (2013.01)

(58) Field of Classification Search
CPC ..... F25D 23/065; F25D 23/069; F25D 23/06; F25D 2331/80; F25D 2400/04
See application file for complete search history.

(56) References Cited

U.S. PATENT DOCUMENTS

| | | | | |
|---|---|---|---|---|
| 2,508,385 | A * | 5/1950 | Hall | F25D 3/125 62/239 |
| 4,898,294 | A * | 2/1990 | Jennings | F25D 3/125 220/592.09 |
| D312,644 | S | 12/1990 | Hase | |
| 5,269,149 | A | 12/1993 | Zeidler | |
| 5,392,615 | A * | 2/1995 | Lim | F25D 17/065 62/408 |
| 5,458,186 | A * | 10/1995 | Lee | F25D 17/065 165/263 |
| 6,131,404 | A * | 10/2000 | Hase | F25D 3/125 165/919 |
| 6,626,508 | B1 | 9/2003 | Hase et al. | |
| 6,895,778 | B1 | 5/2005 | Ackerman | |
| 8,256,242 | B1 | 9/2012 | Evans | |
| 8,863,546 | B2 | 10/2014 | Oberweis | |
| 2004/0177641 | A1 * | 9/2004 | Kim | A47B 49/004 62/441 |
| 2006/0053828 | A1 | 3/2006 | Shallman et al. | |
| 2007/0044502 | A1 * | 3/2007 | Hase | B65B 69/0008 62/371 |
| 2007/0271947 | A1 | 11/2007 | Hase et al. | |
| 2007/0289976 | A1 * | 12/2007 | Meyer | F25D 11/003 220/592.09 |

FOREIGN PATENT DOCUMENTS

| | | | |
|---|---|---|---|
| WO | 2014176330 | A1 | 10/2014 |

* cited by examiner

*Primary Examiner* — Daniel Rohrhoff
(74) *Attorney, Agent, or Firm* — Miller, Matthias & Hull LLP

(57) ABSTRACT

An insulated dual-temperature container for use in transporting multiple payloads that require different temperature environments is provided.

14 Claims, 3 Drawing Sheets

DUAL TEMPERATURE INSULATED CONTAINER

BACKGROUND OF THE INVENTION

1. Field of the Invention

This disclosure relates to a shipping container. More particularly, this disclosure relates to an insulated container for use in transporting multiple payloads that require different temperature environments.

2. Description of the Related Art

Hase U.S. Pat. No. 6,131,404, commonly owned with the present application, describes an insulated container capable of shipping a single payload at different temperatures, depending on the configuration of the drawer-like "cells" 16, 17 and the insulating panels 13, 14, 15. The insulating panel(s) divide an upper room 18 from a lower room 19. The upper room 18 is filled with the drawer-like "cells" 16, 17. By reconfiguring the cells and/or the insulating panels, the temperature of the lower room 19 can be changed.

The present disclosure describes an insulated container capable of shipping multiple payloads at different temperatures.

BRIEF SUMMARY OF THE INVENTION

The present disclosure relates to an insulated dual-temperature container for use in transporting multiple payloads that require different temperature environments.

The container may comprise a housing, a door closure, a first insulated panel, a second insulated panel and refrigerant members. The housing defines an interior and comprises a bottom wall, side walls, a rear wall and a top wall and has an open front.

The open front of the housing may be sealed closed by a single front door or multiple front doors. For example, a single foldable front door may be hingedly attached to a front edge of the top wall and may fold down to seal closed the entire front of the housing. The single front door may include two or more sections hingedly connected to each other.

Alternatively, the open front of the housing may be sealed closed by multiple front doors. For example, an upper front door may be used to close an upper compartment and a lower front door may be used to close a middle and lower compartment.

The first insulated panel may be removably mounted within the housing to define an upper compartment for holding a freezing agent such as dry ice.

The second insulated panel may be removably mounted within the housing below the first insulating panel to define a middle compartment for holding frozen goods and a lower compartment for holding chilled goods. Each refrigerant member may comprise a rigid pouch filled with a phase change material, and may be positioned adjacent an underside of the second insulated panel, such as by being mounted on a rack. The upper compartment, the middle compartment and the lower compartment are arranged vertically.

The container may further comprise a first airflow spacer located in the middle compartment adjacent the second insulated panel and a second airflow spacer located in the lower compartment adjacent the bottom wall.

It is believed that the system takes advantage of convection cooling, as relatively warmer air will rise within the middle compartment, then fall as it is cooled by the relatively colder insulated panel. Similarly, relatively warmer air will rise within the lower compartment, then fall as it is cooled by the refrigerant members. The circulation of air within the compartments minimizes temperature stratification.

DETAILED DESCRIPTION OF THE INVENTION

Figure 1:
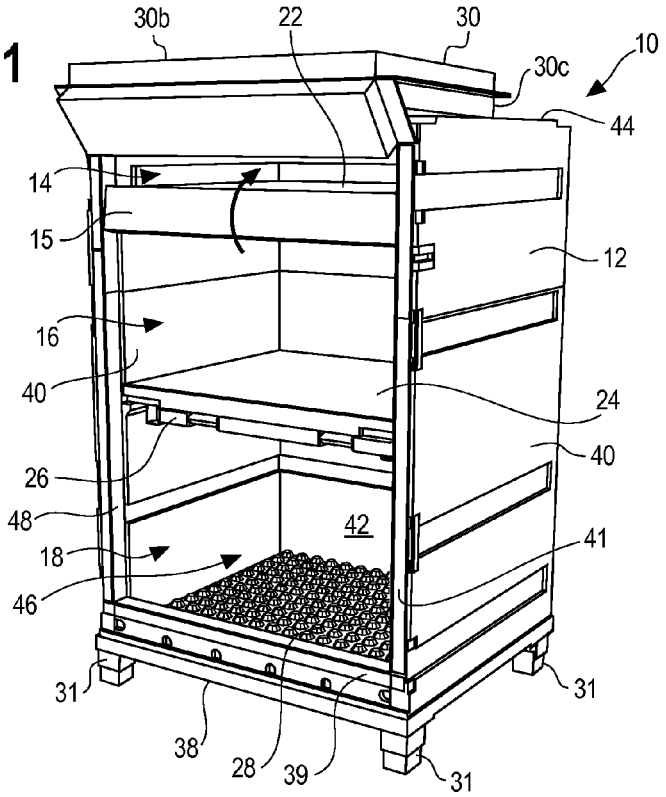
FIG. 1 is perspective view of a container according to the disclosure.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Figure 2:
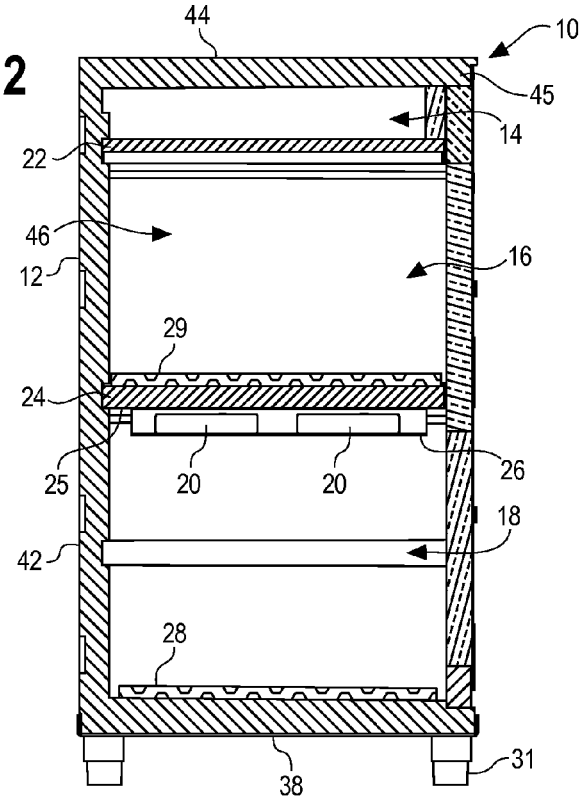
FIG. 2 is a left side cutaway view of a container according to the disclosure.
Figure 3:
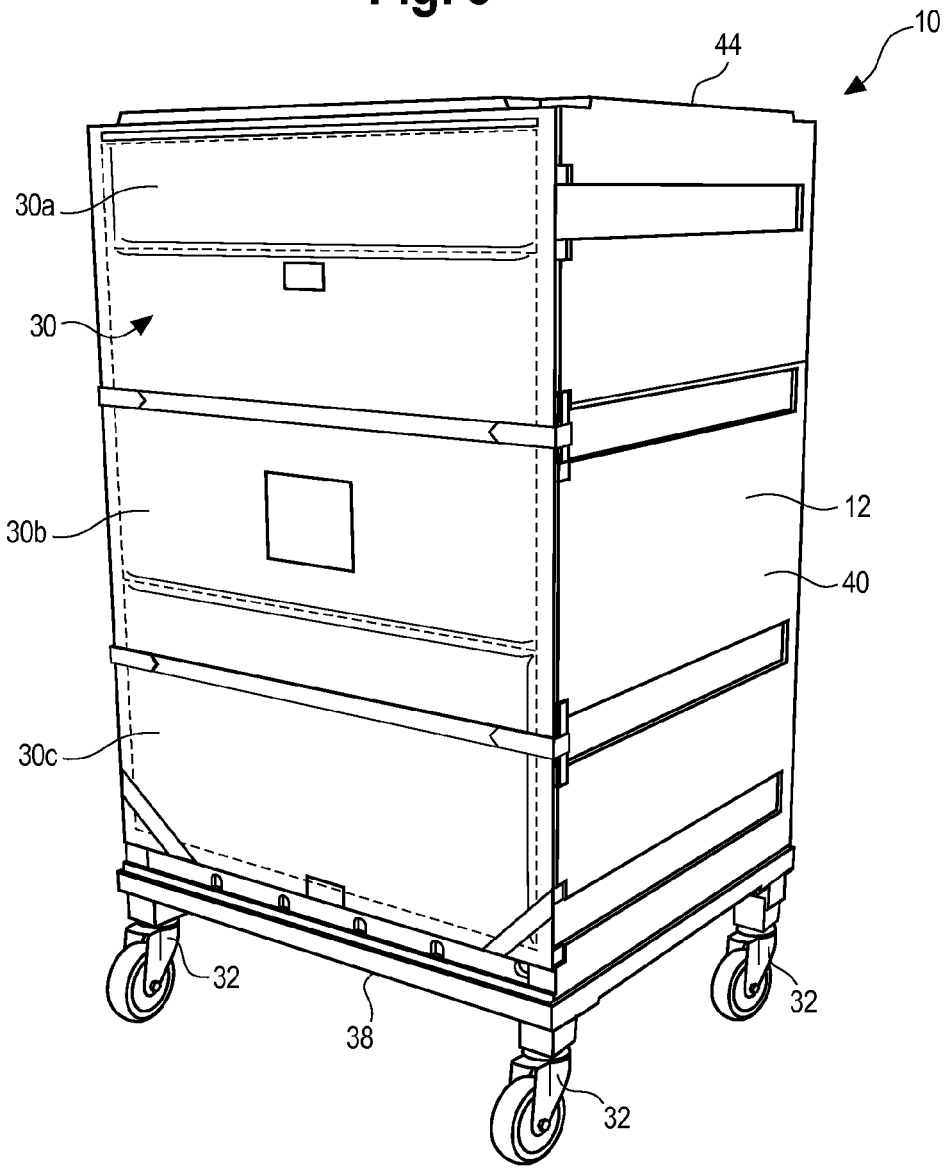
FIG. 3 is perspective view of a second embodiment of a container according to the disclosure shown with the single front door closed.

Turning to the drawings, there is shown in FIGS. 1-3 two embodiments of an insulated container for use in transporting multiple payloads that require different temperature environments. The embodiments are very similar, except that the embodiment shown in FIGS. 1-2 is supported by legs 31 while the embodiment shown in FIG. 3 is supported by wheels 32.

The container 10 comprises a housing 12 defining three compartments arranged vertically in the following order from top to bottom: (1) an upper compartment 14 for holding dry ice, (2) a middle compartment 16 for holding frozen goods, and (3) a lower compartment 18 for holding chilled goods.

The housing 12 may be made by rotational molding and may comprise a bottom wall 38, side walls 40, a rear wall 42 and a top wall 44 defining an interior 46. Each housing wall 38, 40, 42, 44 may comprise an insulating material such as polyurethane (PUR) foam located between outer and inner walls which may be made of fiberglass reinforced plastic, polyethylene plastic, metal or any suitable rigid material.

Front facing surfaces 39, 41, 45 of the bottom wall 38, side walls 40 and top wall 44 respectively form a doorframe 48. As explained in more detail below, various types of front door closures may be used to seal closed the housing interior 46.

The interior 46 may be divided into two or more compartments by various insulated shelves or panels. For example, in the illustrated embodiments, a first insulated panel 22 divides the upper compartment 14 and the middle compartment 16. A second insulated panel 24 divides the middle compartment 16 and the lower compartment 18. The insulated panels 22, 24 may comprise foam insulation, such as plank foam, encapsulated within an envelope, such as a fiber glass reinforced plastic envelope. The envelope or shell may also be rotationally molded polyethylene (PE).

The temperature in each compartment can be partly controlled by altering the insulation value/thickness of the panels 22, 24.

First and second spacers 28, 29 may be disposed on the bottom or side surfaces of the lower compartment 18 and the middle compartment 16 to minimize conductive heat transfer and aid in convective air flow. For example, a first spacer panel 28 located in the lower compartment 18 minimizes or eliminates heat being conducted into the lower compartment 18 from below. Similarly, a second spacer panel 29 located in the middle compartment 16 minimizes or eliminates heat being conducted into the middle compartment 16 from below and provides proper heat transfer (via airflow) from compartment 16 to compartment 18. Preferably the spacer panels 28, 29 are located on a bottom surface of each compartment 16, 18 and are of sufficient dimensions to enable air flow between a payload and the bottom surface.

The performance of the container 10 may be enhanced by placing refrigerant members containing a phase change material (PCM) in the lower compartment 18. The PCM can be water based or a more advanced PCM gel (such as fatty acids, paraffins and hydrated salts) and may be contained within a pouch. The pouch may be flexible or may be rigid, such as a rigid plastic bottle or "brick". For example, in FIGS. 1 and 2, two refrigerant members 20 are mounted on a rack 26 which is attached to the underside 25 of the second insulated panel 24.

Various door closures may be provided to close the container 10. For example, in FIGS. 1-3 a segmented, foldable front door 30 is provided. The front door 30 may be attached to the doorframe 48, such as along a front facing surface 45 of the top wall 44. The front door 30 is formed in three sections 30*a*, 30*b*, 30*c* that are hingedly connected to each other so the front door 30 can be folded up and placed on top of the housing 12 to allow access to the interior 46 while minimizing space needed for opening. In other words, the front door 30 is moveable between a first position in which is folded over upon itself and rests on top of the housing 12 as shown in FIG. 1, and second position in which the front door 30 is located flush against the doorframe 48 to seals closed the housing interior 46 as shown in FIG. 3.

The front door sections 30*a*, 30*b* and 30*c* may be rigid or flexible, and may be secured to the doorframe 48 by any suitable means, including with hook and loop type fasteners, snaps or latches. The front door sections 30*a*, 30*b* and 30*c* may comprise insulating material such as polyurethane (PUR) foam encapsulated between rigid, semi-rigid or flexible outer and inner walls.

Figure 4:
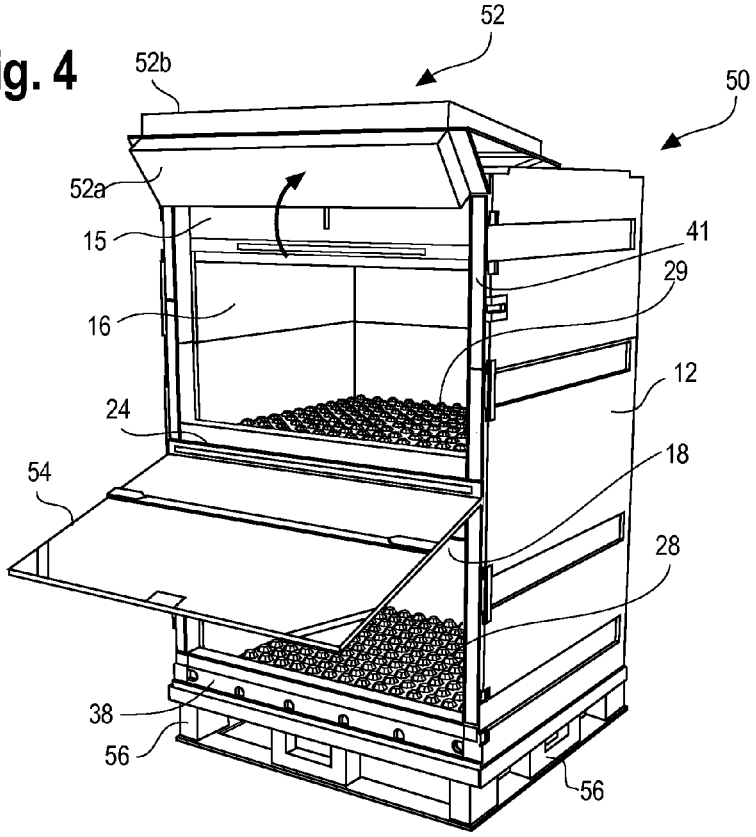
FIG. 4 is perspective view of a third embodiment of a container according to the disclosure.
Figure 5:
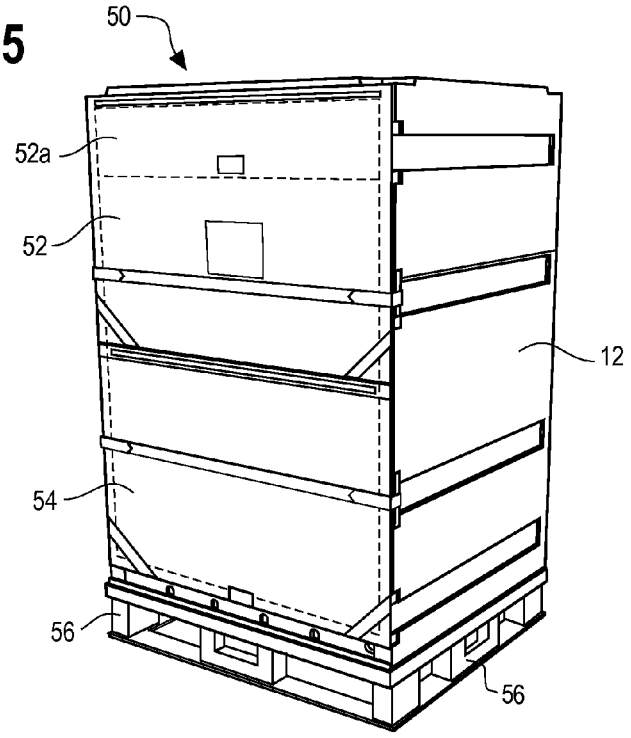
FIG. 5 is perspective view of the container of FIG. 4 shown with both front doors closed.

Alternatively, the door closure may take the form of multiple front doors that can selectively and independently open and close the different compartments. For example, FIGS. 4 and 5 are perspective views of an alternative container 50 similar in most respects to the previous embodiments except that the container 50 has two front doors and is supported by a pallet 56. The front doors comprise an upper front door 52 and a lower front door 54. The upper front door 52 may be used to close the upper compartment 14 (obscured in FIG. 4 by a separate upper compartment door 15) and the middle compartment 16. The lower front door 36 may be used to close the lower compartment 18.

In FIGS. 4 and 5 the upper front door 52 is segmented and comprises two sections 52*a* and 52*b* hingedly connected to each other so the upper front door 52 can be folded up and placed on top of the housing 12 to allow access to the upper compartment 14 and the middle compartment 16 while leaving the lower compartment 18 closed. The lower front door 54 is shown hingedly affixed to a front facing surface of the second insulated panel 24, and can be raised to allow access to the lower compartment 18 while leaving the upper compartment 14 and the middle compartment 16 closed.

Of course, other door closures and door configurations may be used. For example and without limitation, the upper and lower front doors 52, 54 may be hingedly affixed to the front facing surfaces 41 of the side walls 40.

A flexible insulated upper compartment door 15, separate and distinct from the door closures described above, may be hingedly or otherwise attached to the front insulated panel 22 or to the housing 12 and may be used to provide an additional insulative barrier to the upper compartment 14 by covering the open front of the upper compartment 14. The upper compartment door 15 may comprise foam insulation in the form of flexible foam encapsulated within a second material such as vinyl reinforced type material. The upper compartment door 15 is moveable between a first position in which the upper compartment door 15 is located above the front insulated panel 22 and seals closed the upper compartment 14, and a second position in which the upper compartment door 15 is suspended below the front insulated panel 22, leaving the upper compartment 14 open.

The container housing 12 may be mounted on legs 31 (as shown in FIGS. 1-2), wheels 32 (as shown in FIG. 3), runners, a pallet 56 (as shown in FIGS. 4-5) or any other suitable supports. If a pallet 56 is used, the pallet 56 may define one or more openings to receive forklift tynes.

Method of Use

The container 10 may be used in the following manner. First, the user loads dry ice or other freezing agent into the upper compartment 14. A typical dry ice load may consist of about 240 lbs. of dry ice slabs, positioned four slabs wide, three slabs deep and about two slabs in height. After loading the dry ice into the upper compartment 14 the upper compartment door 15 is positioned to cover the upper compartment 14.

The user also may place about ten pounds of dry ice or other freezing agent into the middle compartment 16 for pre-cool.

Next, the user places pre-conditioned refrigerant members 20 into the middle compartment 16 by, for example, placing them on a sliding aluminum rack 26 that then can be slid back into position just under the second insulated panel 24 and preferably above the payload space. The door closure, such as foldable front door 30, may be folded down, rolled down, or otherwise closed to cover the upper compartment 14, middle compartment 16 and the lower compartment 18.

The user may allow the container 10 to cool down, preferably for a minimum of an hour, before loading payload into the middle compartment 16 and/or the lower compartment 18.

Theory of Operation

The container 10 is believed to function in the following manner. Dry ice in the upper compartment 14 cools the first insulated panel 22, and thus the middle compartment 16 below it. The cold air in the middle compartment 16 then cools the second insulated panel 24 and the lower compartment 18 below it.

It is believed that the system takes advantage of convection cooling, as relatively warmer air will rise within the middle compartment 16, then fall as it is cooled by the relatively colder insulated panel 22. Similarly, relatively warmer air will rise within the lower compartment 18, then fall as it is cooled by the PCM bricks 20. The circulation of air within the compartments 16, 18 along with the airflow spacers 28, minimizes temperature stratification.

INDUSTRIAL APPLICABILITY

The dual temperature container can be used for applications requiring multiple payloads kept at different temperatures. For example and without limitation, the container can be used to ship frozen and chilled perishables in a single container.

The embodiments described above are only particular examples which serve to illustrate the principles of the invention. Modifications and alternative embodiments are contemplated which do not depart from the scope of the invention as defined by the foregoing teachings and appended claims. It is intended that the claims cover all such modifications and alternative embodiments that fall within their scope.

The invention claimed is:

1. A container for use in transporting multiple payloads that require different temperature environments, the container comprising:

a housing defining an interior and comprising a bottom wall, side walls, a rear wall and a top wall;

a door closure affixed to the housing for closing the container;

a first insulated panel removably mounted within the housing to define an upper compartment for holding a freezing agent;

a second insulated panel removably mounted within the housing below the first insulating panel to define a middle compartment for holding a frozen payload and a lower compartment for holding a chilled payload; and one or more refrigerant members located within the lower compartment, each refrigerant member comprising a closed container filled with a phase change material; wherein the upper compartment, the middle compartment and the lower compartment are arranged vertically.

2. The container of claim 1 wherein:

front facing surfaces of the bottom wall, side walls and top wall respectively form a doorframe.

3. The container of claim 1 further comprising:

a first airflow spacer located in the middle compartment adjacent the second insulated panel; and a second airflow spacer located in the lower compartment adjacent the bottom wall.

4. The container of claim 1 wherein:

the door closure is a front door comprising three sections hingedly connected to each other.

5. The container of claim 4 wherein:

the front door is moveable between a first position in which the front door seals closed the housing, and a second position in which the front door rests on top of the housing.

6. The container of claim 5 wherein:

the front door sections comprise insulating foam encapsulated between outer and inner walls.

7. The container of claim 1 wherein:

the door closure comprises an upper front door and a lower front door.

8. The container of claim 7 wherein:

the upper front door is configured to close the upper compartment and the middle compartment, and the lower front door is configured to close the lower compartment.

9. The container of claim 8 wherein:

the upper front door is segmented and comprises two sections hingedly connected to each other.

10. The container of claim 8 wherein:

the lower front door is hingedly affixed to a front facing surface of the second insulated panel.

11. The container of claim 1 further comprising:

an insulated upper compartment door hingedly attached to the first insulated panel and moveable between a first position in which the upper compartment door is located above the front insulated panel and seals closed the upper compartment, and a second position in which the upper compartment door is suspended below the front insulated panel, leaving the upper compartment open.

12. The container of claim 11 wherein:

the upper compartment door comprises foam insulation encapsulated within a second material.

13. The container of claim 1 wherein:

the container is mounted on supports.

14. A container for use in transporting multiple payloads that require different temperature environments, the container comprising:

a housing defining an interior and comprising a bottom wall, side walls, a rear wall and a top wall;

a door closure affixed to the housing for closing the container;

a first insulated panel removably mounted within the housing to define an upper compartment for holding a freezing agent;

a second insulated panel removably mounted within the housing below the first insulating panel to define a middle compartment for holding a frozen payload and a lower compartment for holding a chilled payload; and one or more refrigerant members located within the lower compartment, each refrigerant member comprising a container filled with a phase change material; wherein the upper compartment, the middle compartment and the lower compartment are arranged vertically; and wherein:

each refrigerant member is mounted on a rack adjacent an underside of the second insulated panel.

* * * * *